US011248176B2

(12) United States Patent
Hodgkins et al.

(10) Patent No.: US 11,248,176 B2
(45) Date of Patent: Feb. 15, 2022

(54) LOW-SULFUR AROMATIC-RICH FUEL OIL BLENDING COMPONENT

(71) Applicant: SAUDI ARABIAN OIL COMPANY, Dhahran (SA)

(72) Inventors: Robert Peter Hodgkins, Dhahran (SA); Omer Refa Koseoglu, Dhahran (SA)

(73) Assignee: SAUDI ARABIAN OIL COMPANY (SA)

( * ) Notice: Subject to any disclaimer, the term of this patent is extended or adjusted under 35 U.S.C. 154(b) by 175 days.

(21) Appl. No.: 16/554,057

(22) Filed: Aug. 28, 2019

(65) Prior Publication Data

US 2021/0062096 A1 Mar. 4, 2021

(51) Int. Cl.
*C10G 21/14* (2006.01)
*C10G 29/20* (2006.01)

(52) U.S. Cl.
CPC ..... *C10G 21/14* (2013.01); *C10G 29/205* (2013.01); *C10G 2300/104* (2013.01); *C10G 2300/1051* (2013.01); *C10G 2300/1077* (2013.01); *C10G 2300/1096* (2013.01)

(58) Field of Classification Search
CPC ..... C10G 21/14; C10G 29/205; C10G 2300/104; C10G 2300/1051; C10G 2300/1077; C10G 2300/1096; C10G 47/00; C10G 45/44; C10L 1/04
See application file for complete search history.

(56) References Cited

U.S. PATENT DOCUMENTS 2,360,272 A 10/1944 Plummer
2,971,828 A 2/1961 Churchill et al.
3,533,938 A 10/1970 Leas
4,746,420 A 5/1988 Darian et al.
5,593,567 A 1/1997 Jessup et al.
5,653,866 A 8/1997 Jessup et al.
5,837,126 A 11/1998 Jessup et al.
6,030,521 A 2/2000 Jessup et al.
6,179,995 B1 1/2001 Cash et al.
(Continued)

FOREIGN PATENT DOCUMENTS

CN 204122052 U 1/2015
CN 104327879 A 2/2015
WO 2015052261 A1 4/2015

OTHER PUBLICATIONS

"Heavy Fuel Oils Category Analysis and Hazard Characterization",The American Petroleum Institute Petroleum HPV Testing Group, 2012, p. 138.

(Continued)

*Primary Examiner* — Randy Boyer
*Assistant Examiner* — Juan C Valencia
(74) *Attorney, Agent, or Firm* — Bracewell LLP; Constance Gall Rhebergen

(57) ABSTRACT

Refinery processes, systems, and compositions for making an aromatic blending component for fuel oil, and a fuel oil blend using the same. Valuable hydrocarbons like kerosene can be reduced or eliminated from fuel oil blends by adding certain aromatic blending components derived from the aromatic bottoms stream of an aromatic recovery complex. The aromatic blending component can be used in lieu of more costly hydrocarbon streams to decrease the overall viscosity of the fuel oil blend without adding sulfur.

12 Claims, 5 Drawing Sheets

(56) References Cited

U.S. PATENT DOCUMENTS

| | | | |
|---|---|---|---|
| 6,633,043 | B2 | 10/2003 | Hegazi et al. |
| 7,501,285 | B1 | 3/2009 | Triche et al. |
| 7,591,939 | B2 | 9/2009 | Benham |
| 7,939,335 | B1 | 5/2011 | Triche et al. |
| 7,980,312 | B1 | 7/2011 | Hill et al. |
| 8,206,574 | B2 | 6/2012 | Etter |
| 8,235,117 | B1 | 8/2012 | Hill et al. |
| 8,261,823 | B1 | 9/2012 | Hill et al. |
| 8,361,310 | B2 | 1/2013 | Etter et al. |
| 8,372,264 | B2 | 2/2013 | Etter |
| 8,372,265 | B2 | 2/2013 | Etter |
| 8,394,257 | B2 | 3/2013 | Etter |
| 8,888,991 | B2 | 11/2014 | Etter |
| 8,968,553 | B2 | 3/2015 | Etter |
| 9,011,672 | B2 | 4/2015 | Etter et al. |
| 9,085,972 | B1 | 7/2015 | Hill et al. |
| 9,150,796 | B2 | 10/2015 | Etter |
| 9,187,701 | B2 | 11/2015 | Etter |
| 9,200,207 | B2 | 12/2015 | Huang et al. |
| 9,475,992 | B2 | 10/2016 | Etter |
| 2004/0144689 | A1 | 7/2004 | Berlowitz et al. |
| 2006/0049080 | A1 | 3/2006 | Bacha et al. |
| 2007/0021636 | A1 | 1/2007 | Bosch |
| 2007/0187291 | A1 | 8/2007 | Miller et al. |
| 2014/0174980 | A1 | 6/2014 | Brown et al. |
| 2018/0230070 | A1* | 8/2018 | Beadle ..... C07C 4/26 |
| 2018/0319720 | A1 | 11/2018 | Beadle et al. |
| 2019/0016980 | A1 | 1/2019 | Kar et al. |
| 2019/0127651 | A1* | 5/2019 | Kar ..... C10L 10/12 |
| 2019/0241486 | A1 | 8/2019 | Koseoglu et al. |

OTHER PUBLICATIONS

Simanzhenkov et al., "Technology for Producing Petrochemical Feedstock from Heavy Aromatic Oil Fractions", Industrial & Engineering Chemistry Research, 2010, pp. 953-963, American Chemical Society.

International Search Report and Written Opinion of PCT/US2020/048517 dated Oct. 30, 2020, 12 pages.

* cited by examiner

LOW-SULFUR AROMATIC-RICH FUEL OIL BLENDING COMPONENT

FIELD

This disclosure relates to a fuel oil blending component, processes and systems for making a fuel oil blending component, a fuel oil, and compositions of the same.

BACKGROUND

Conventional fuel oils are used in marine and shipping applications due to their relative abundance and affordability. Fuel oils must comply with strict specifications to be marketable. Fuel oils are typically blends of various hydrocarbon streams including vacuum residue oil and significant volumes of less viscous kerosene, light gas oil, and fluid catalytic cracking cycle and decant oil (FCC DCO), visbroken residues, and delayed coking liquids. Vacuum residue oil is a viscous hydrocarbon stream that requires blending with other hydrocarbon streams to reduce viscosity and to meet other fuel oil specifications. The addition of kerosene and light gas oil provides refineries with a pathway to regulatory compliance by reducing the viscosity of the blend to specified levels, but since these components are significantly more valuable than the resulting fuel oil blend their use should be minimized.

SUMMARY

A general object of this disclosure is to provide a fuel oil blend with an aromatic blending component and a process for making a fuel oil with an aromatic blending component. The aromatic blending component can reduce the need for more valuable fuel oil components, like kerosene and light gas oil, while meeting fuel oil specifications. An aromatic blending component derived from the aromatic bottoms of an aromatic recovery complex can reduce the viscosity of the fuel oil without adding significant amounts of sulfur.

An aromatics complex processes an aromatic feedstock such as straight-run naphtha, reformed naphtha, pyrolysis gasoline, or coke-oven light oil to recover benzene, toluene, and mixed xylenes. In the process, certain heavy aromatic compounds are removed from the process as aromatic bottoms. These aromatic bottoms can be used as an aromatic blending component in fuel oil in lieu of more valuable components like kerosene and light gas oil. Aromatic bottoms and certain blend components derived from aromatic bottoms can reduce the viscosity of the blend without adding significant amounts of sulfur, allowing refiners to meet desired specifications while minimizing kerosene and light gas oil content. The aromatic blending component can be straight-run aromatic bottoms, hydrodearylated aromatic bottoms, or a heavy fraction of aromatic bottoms.

An embodiment of a process for making a fuel oil blend having an aromatic-rich component includes: supplying an aromatic bottoms; supplying an aromatic blending component from the aromatic bottoms; blending the aromatic blending component with bulk fuel oil components to produce a fuel oil blend. The bulk fuel oil components can include a hydrocarbon component selected from the group consisting of: vacuum residue oil, light gas oil, kerosene, FCC DCO, visbroken residues, delayed coking liquids, and combinations of the same.

In at least one embodiment, the aromatic blending component includes straight-run aromatic bottoms.

In certain embodiments, the step of supplying an aromatic blending component from the aromatic bottoms includes hydrodearylating the aromatic bottoms to produce hydrodearylated aromatic bottoms and fractionating the hydrodearylated aromatic bottoms to obtain heavy hydrodearylated aromatic bottoms. The aromatic blending component can include the heavy hydrodearylated aromatic bottoms. In at least one embodiment, the heavy hydrodearylated aromatic bottoms can have an initial boiling point above about 180° C. In at least one embodiment, the heavy hydrodearylated aromatic bottoms includes $C_{11+}$ aromatics.

In certain embodiments, the step of supplying an aromatic blending component from the aromatic bottoms also includes fractionating the aromatic bottoms to obtain heavy aromatic bottoms. The aromatic blending component can include the heavy aromatic bottoms. In at least one embodiment, the heavy aromatic bottoms has an initial boiling point above about 180° C. In at least one embodiment, the heavy aromatic bottoms includes $C_{11+}$ aromatics.

In certain embodiments, the step of supplying an aromatic blending component includes hydrodearylating heavy aromatic bottoms to produce hydrodearylated aromatic bottoms, and fractionating the hydrodearylated aromatic bottoms to obtain light alkyl monoaromatics and heavy hydrodearylated aromatic bottoms. The aromatic blending component can include the heavy hydrodearylated aromatic bottoms. In at least one embodiment, the heavy hydrodearylated aromatic bottoms can have an initial boiling point above about 180° C. In at least one embodiment, the heavy hydrodearylated aromatic bottoms can include $C_{11+}$ aromatics.

An embodiment of a fuel oil blending unit for producing a fuel oil blend includes an aromatic blending component stream that includes an aromatic blending component produced from aromatic bottoms, and a bulk fuel oil component inlet stream that includes a bulk fuel oil component selected from the group consisting of: vacuum gas oil, light gas oil, kerosene, FCC DCO, visbroken residues, delayed coking liquids, and combinations of the same. The aromatic blending component stream introduces the aromatic blending component to the fuel oil blending unit and the bulk fuel oil component inlet stream introduces the bulk fuel oil component to the fuel oil blending unit. The fuel oil blending unit is operable to blend the bulk fuel oil component and aromatic blending component, and produce a fuel oil. The fuel oil leaves the fuel oil blending unit in a fuel oil outlet stream.

In certain embodiments, the fuel oil blending unit can include a hydrodearylation unit that receives aromatic bottoms from an inlet stream and hydrodearylates the aromatic bottoms to produce hydrodearylated aromatic bottoms. The hydrodearylated aromatic bottoms leave the hydrodearylation unit in a hydrodearylated aromatic bottoms stream, and the hydrodearylated aromatic bottoms stream supplies the hydrodearylated aromatic bottoms to a distillation unit where the hydrodearylated aromatic bottoms are fractionated to obtain heavy hydrodearylated aromatic bottoms. Here, the aromatic blending component includes the heavy hydrodearylated aromatic bottoms, which leave the distillation unit in the aromatic blending component stream. In at least one embodiment, the inlet stream includes a heavy fraction of aromatic bottoms.

An embodiment of a fuel oil blend composition includes a bulk fuel oil component and an aromatic blending component, the aromatic blending component made by a process that includes: supplying an aromatic feedstock, processing the aromatic feedstock in an aromatic recovery complex to produce aromatic products and aromatic bottoms, supplying an aromatic blending component from the aromatic bottoms, and blending the aromatic blending component with a bulk fuel oil component to produce the fuel oil blend composition. The aromatic blending component can include heavy alkyl aromatic hydrocarbons and alkyl multiaromatic hydrocarbons. The bulk fuel oil component includes a hydrocarbon component selected from the group consisting of: vacuum residue oil, light gas oil, kerosene, FCC DCO, visbroken residues, delayed coking liquids, and combinations of the same.

In at least one embodiment, the aromatic blending component has a Hildebrand solubility parameter above about 16.0 (megapascals)$^{1/2}$ (MPa$^{1/2}$). In certain embodiments, the fuel oil includes less than about 15 volume percent (vol %) kerosene, and alternatively less than about 10 vol %. In certain embodiments, the fuel oil includes more than about 50 vol % vacuum residue oil, and alternatively more than about 60 vol %. In certain embodiments, the fuel oil includes about 0.1-10.0 vol % aromatic blending component, and in the range of about 0.1-5 vol % in some embodiments.

BRIEF DESCRIPTION OF THE DRAWINGS

The embodiments disclosed here will be understood by the following detailed description along with the accompanying drawings. The embodiments in the figures are given as examples; the disclosure is not limited to the content of the illustrations.

DETAILED DESCRIPTION

Figure 1:
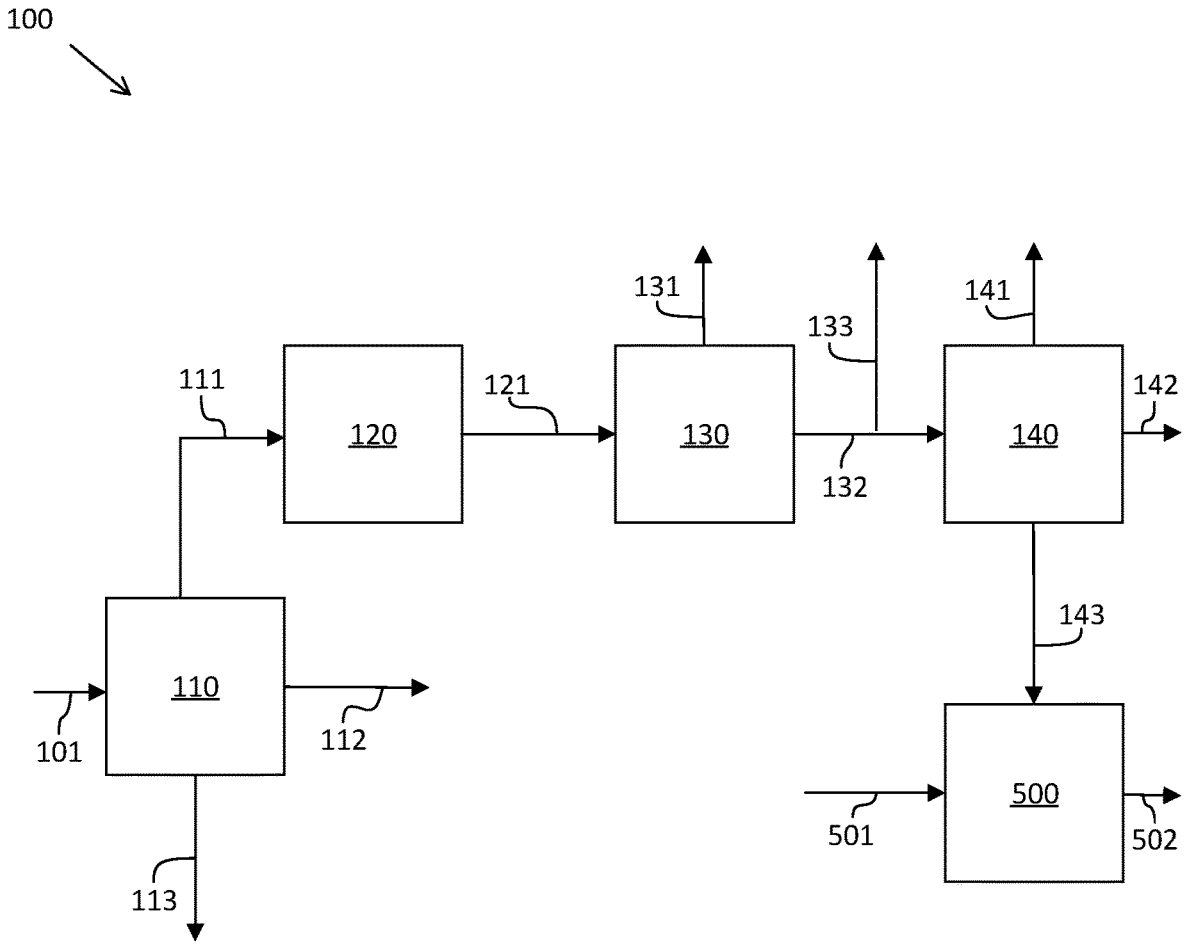
FIG. 1 is a schematic diagram of a process that produces and uses a straight-run aromatic bottoms as an aromatic blending component.

This disclosure describes various embodiments related to processes, systems, and compositions for making an aromatic blending component and fuel oil. Further embodiments are described and disclosed.

For certain embodiments, many details are provided for thorough understanding of the various components or steps. In other instances, well-known processes, devices, compositions, and systems are not described in particular detail so that the embodiments are not obscured by details. Likewise, illustrations of the various embodiments can omit certain features or details so that various embodiments are not obscured.

The drawings provide an illustration of certain embodiments. Other embodiments can be used, and logical changes can be made without departing from the scope of this disclosure. The following detailed description is not to be taken in a limiting sense.

The description can use the phrases "in some embodiments," "in various embodiments," "in an embodiment," or "in embodiments," which can each refer to one or more of the same or different embodiments. Furthermore, the terms "comprising," "including," "having," and the like, as used with respect to embodiments of the present disclosure, are synonymous.

Ranges can be expressed in this disclosure as from about one particular value and to about another particular value. When such a range is expressed, it is to be understood that another embodiment is from the one particular value and/or to the other particular value, along with all combinations within said range. When the range of values is described or referenced in this disclosure, the interval encompasses each intervening value between the upper limit and the lower limit as well as the upper limit and the lower limit and includes smaller ranges of the interval subject to any specific exclusion provided.

Where a method having two or more defined steps is recited or referenced herein, the defined steps can be carried out in any order or simultaneously except where the context excludes that possibility.

Various embodiments are described in detail for the purpose of illustration, but they are not to be construed as limiting. Instead, this disclosure is intended to disclose certain embodiments with the understanding that many other undisclosed changes and modifications can fall within the spirit and scope of the disclosure.

As used in this disclosure, the term "stream" (and variations of this term, such as hydrocarbon stream, feedstream, product stream, and the like) can include one or more of various hydrocarbon compounds and can include various impurities.

As used in this disclosure, the terms "aromatic recovery complex" and "aromatic complex" are used synonymously and refer to the combination of process units that process a hydrocarbon stream to recover the aromatic intermediates: benzene, toluene, and xylenes. Aromatic recovery complexes can have many different configurations, and can include different process units. An aromatic recovery complex has an aromatics extraction unit for the extraction of aromatic compounds such as benzene, toluene, and xylene, and can include a naphtha hydrotreating unit for the removal of sulfur and nitrogen contaminants. An aromatic recovery complex can also include process units for the conversion of toluene and heavy aromatics to xylenes and benzene, and can include process units for producing one or more xylene isomers.

As used in this disclosure, the term "aromatic bottoms" refers to the effluent from an aromatic recovery complex after the aromatic products are extracted. Aromatic bottoms can include the heavy fraction from a p-xylene extraction unit. A typical aromatic bottoms stream is rich in $C_{11+}$ aromatics, including alkylated monoaromatics and condensed and noncondensed alkylated multiaromatic compounds.

As used in this disclosure, the term "rich" means an amount of at least 50% or greater, by mole percentage of a compound or class of compounds in a stream. Certain streams rich in a compound or class of compounds can contain about 70% or greater, by mole percentage of the particular compound or class of compounds in the streams. In certain cases, mole percentage can be replaced by weight percentage, in accordance with standard industry usage.

As used in this disclosure, the term "substantially" means an amount of at least 80%, by mole percentage of a compound or class of compounds in a stream. Certain streams substantially containing a compound or class of compounds can contain at least about 90%, by mole percentage of the compound or class of compounds in the streams. Certain streams substantially containing a compound or class of compounds can contain at least 99%, by mole percentage of the compound or class of compounds in the streams. In certain cases, mole percentage can be replaced by weight percentage, in accordance with standard industry usage.

As used in this disclosure, the term "hydrodearylation" refers to a process for the cleaving of the alkyl bridge of noncondensed alkyl-bridged multi-aromatics or heavy alkyl aromatic compounds to form alkyl mono-aromatics, in the presence of a catalyst and hydrogen.

The aromatic blending component is an aromatic-rich hydrocarbon stream that is substantially derived from aromatic bottoms from an aromatic recovery complex. The aromatic blending component can be straight-run aromatic bottoms, a heavy fraction of aromatic bottoms, or heavy hydrodearylated aromatic bottoms. The aromatic blending component includes alkylated multiaromatic compounds. In certain embodiments, the alkylated multiaromatic compounds are a mixture of condensed and noncondensed alkylated multiaromatic compounds. In certain embodiments, the alkylated multiaromatic compounds in the aromatic blending component are substantially condensed; and this is especially true of embodiments using aromatic blending components that include heavy hydrodearylated aromatic bottoms. The aromatic blending component can have a Hildebrand solubility parameter of at least about 18.0 $MPa^{1/2}$, at least about 20.0 $MPa^{1/2}$ in some embodiments, and in the range of about 20.0-22.0 $MPa^{1/2}$ in some embodiments.

In an aromatic recovery process, a variety of process units are used to process naphtha, pyrolysis gasoline, or coke-oven light oil to produce benzene, toluene, and mixed xylenes, which are basic petrochemical intermediates used for the production of various other chemical products. In order to maximize the production of benzene, toluene, and mixed xylenes, the feed to an aromatics complex is generally limited from $C_6$ up to $C_{11}$ compounds. In most aromatics complexes, mixed xylenes are processed within the complex to produce the particular isomer p-xylene, which can be processed downstream to produce terephthalic acid. Terephthalic acid is used to make polyesters, such as polyethylene terephthalate. In order to increase the production of benzene and p-xylene, the toluene and $C_9$ and $C_{10}$ aromatics are processed within the complex through a toluene, $C_9$, $C_{10}$ transalkylation/toluene disproportionation (TA/TDP) process unit to produce benzene and xylenes. Any remaining toluene, $C_9$ and $C_{10}$ are recycled to extinction. Compounds heavier than $C_{10}$ are generally not processed in the TA/TDP unit because they tend to deactivate the catalysts used in these units. These heavy compounds are removed from the aromatic recovery complex in an aromatic bottoms stream.

In certain embodiments, the $C_{8+}$ fraction of reformate primarily contains aromatics (that is, generally more than 95%). The olefinic species in this fraction are composed primarily of alkenyl aromatics, such as styrene and methylstyrene. Such molecules would be expected to react across clay-containing Lewis-acid sites with the alkyl aromatics via a Friedel-Crafts reaction to form molecules with two aromatic rings connected with an alkyl bridge. This reaction is typically occurs at temperatures around 200° C. Alkenyl aromatics may react, in turn, with these compounds to form multiaromatic compounds with additional aromatic rings connected by alkyl bridges. Such noncondensed multiaromatic having two or more aromatic rings connected by alkyl bridges may be characterized as having a relatively high density (that is, above about 900 kilograms per cubic meter ($kg/m^3$)), a darker brown color (Standard Reference Method Color greater than 20), and higher boiling points (that is, above about 280° C.), as compared to nonbridged alkyl aromatics. The remaining nonaromatic olefin portion of the $C_{8+}$ fraction of the reformate in this embodiment would be expected to react across clay-containing Lewis acid sites with alkyl aromatics via a Friedel-Crafts reaction to form monoaromatic molecules with at least one large (more than seven carbon atoms) alkyl group. This reaction typically occurs at temperatures around 200° C. The heavy monoaromatics produced by this reaction can be characterized as having a moderately high density (that is, above about 800 $kg/m^3$), and higher boiling points (that is, above about 250° C.), as compared with lighter alkyl aromatics. Such heavy molecules are separated from $C_9$ and $C_{10}$ monoaromatics by fractionation before the $C_9$ and $C_{10}$ aromatics are sent to the TA/TDP process unit for conversion to benzene and xylenes.

By way of example and not limitation, multiaromatic compounds found in an aromatic bottoms stream include various alkyl-bridged noncondensed alkyl aromatic compounds as shown in Formula I, Formula II, and Formula III, and variations of these compounds.

[Formula I]

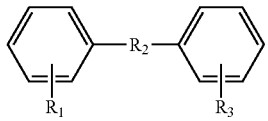

[Formula II]

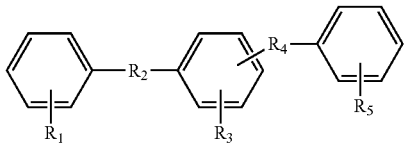

[Formula III]

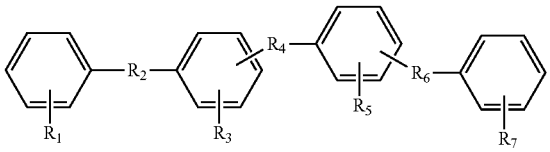

$R_2$, $R_4$, and $R_6$ are alkyl bridge groups independently having from two to six carbon atoms. $R_1$, $R_3$, $R_5$, and $R_7$ are independently selected from the group consisting of hydrogen and an alkyl group having from one to eight carbon atoms. In addition to the groups $R_1$, $R_3$, $R_5$, and $R_7$, the benzene groups of Formulas I, II, and III can further include additional alkyl groups connected to the benzene groups. In addition to the four benzene groups of Formula III, the various alkyl-bridged noncondensed alkyl aromatic compounds can include five or more benzene groups connected by alkyl bridges, where the additional benzene groups further can include alkyl groups connected to the additional benzene groups.

By way of example and not limitation, multiaromatic compounds found in an aromatic bottoms stream include various condensed alkyl aromatic compounds as shown in Formula IV, Formula V, and Formula VI, Formula VII, and variations of these compounds.

[Formula IV]

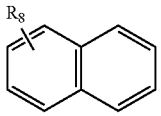

[Formula V]

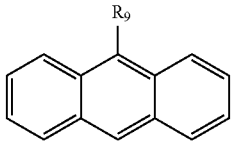

[Formula VI]

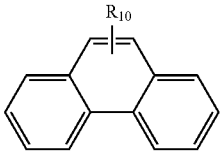

[Formula VII]

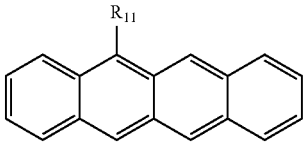

Formula IV, Formula V, Formula VI, and Formula VII show examples of condensed multiaromatics. The fused rings in the formulas are characteristic of condensed multiaromatics. $R_8$, $R_9$, $R_{10}$, and $R_{11}$ are independently selected from the group consisting of hydrogen and an alkyl group having from one to eight carbon atoms. The positions of $R_8$, $R_9$, $R_{10}$ and $R_{11}$ are exemplary only, and additional alkyl groups can bond to benzene groups in Formula IV, Formula V, Formula VI, and Formula VII in other locations.

Processing of a stream containing multiaromatic compounds can include separation from lighter unreacted alkyl aromatics by fractionation, where a separation process can provide at least one low boiling point (or light) fraction containing reduced levels of olefins and at least one high boiling point (or heavy) fraction containing the multiaromatic compounds along with high boiling point alkyl aromatics. In various embodiments, the heavy aromatic bottoms fraction includes compounds boiling at a temperature above 180° C. In various embodiments, the heavy aromatic bottoms fraction includes $C_{11+}$ compounds. The fraction containing the multiaromatic compounds can be used as a gasoline blending component because it has suitable octane; however, constraints on density, color, and boiling point can limit the amount that can be blended into a gasoline stream. The heavy fraction containing the multiaromatic compounds typically is not processed in catalytic units such as a TA/TDP unit because the condensed multiaromatics in the heaviest fractions with greater than ten carbon atoms tend to form catalyst-deactivating coke layers at the conditions used in such units. The formation of coke layers potentially limits catalyst life between regenerations.

Processing of a stream containing heavy alkyl multiaromatic compounds can include hydrodearylation. Hydrodearylation includes reacting heavy alkyl aromatic compounds and alkyl-bridged noncondensed alkyl multiaromatic compounds with hydrogen in the presence of a catalyst under specific reaction conditions to produce a product stream containing one or more alkyl monoaromatic compounds. The alkyl-bridged noncondensed alkyl multiaromatic compounds include at least two benzene rings connected by an alkyl bridge group having at least two carbons, wherein the benzene rings are connected to different carbons of the alkyl bridge group.

The catalyst can be presented as a catalyst bed in the reactor. A portion of the hydrogen stream can be fed to the catalyst bed in the reactor to quench the catalyst bed. The catalyst bed can include two or more catalyst beds. The catalyst can include a support being at least one member of the group consisting of silica, alumina, and combinations thereof, and can further include an acidic component being at least one member of the group consisting of amorphous silica-alumina, zeolite, and combinations thereof. The catalyst can be a metal from IUPAC Group 8-10 being at least one member of the group consisting of iron, cobalt, and nickel, and combinations thereof and further includes an IUPAC Group 6 metal being at least one member of the group consisting of molybdenum and tungsten, and combinations thereof. The IUPAC Group 8-10 metal can be 2-20 percent by weight (wt %) of the catalyst and the IUPAC Group 6 metal can be 1-25 wt % of the catalyst. In some embodiments, the catalyst can include nickel, molybdenum, ultra-stable Y-type zeolite, and γ-alumina support.

Because the alkyl bridge in alkyl noncondensed alkyl aromatics is broken during the hydrodearylation process to produce lighter monoaromatics, the heavy alkyl multiaromatics remaining after hydrodearylation are mostly condensed multiaromatics; at least 60% in some embodiments, at least 80% in some embodiments, and at least 95% in some embodiments. In certain embodiments, the specific reaction conditions for the hydrodearylation process include an operating temperature of the reactor during the hydrodearylation reaction being in the range of 200 to 450° C. The operating temperature of the reactor during the hydrodearylation reaction can be about 300° C. The operating temperature of the reactor during the hydrodearylation reaction can be about 350° C. The specific reaction conditions can include a hydrogen partial pressure in the reactor during the hydrodearylation reaction being in the range of 5-80 bar gauge. The hydrogen partial pressure in the reactor during the hydrodearylation reaction can be maintained at less than 20 bar gauge. The specific reaction conditions can include a feed rate of the hydrogen stream being in the range of 500-5000 standard cubic feet per barrel of feedstock. Operating conditions can include a liquid hourly space velocity of the reactor of about 0.5-10 per hour. The hydrogen stream can contain at least 70% hydrogen by weight. The catalyst can be provided as a catalyst bed in the reactor. In certain embodiments, a portion of the hydrogen stream is fed to the catalyst bed of the reactor to quench the catalyst bed.

The hydrodearylation process can include the step of supplying hydrodearylated aromatic bottoms to a separation zone to separate the product into a lighter hydrocarbon stream and a heavier hydrocarbon stream. The lighter hydrocarbon stream can be processed to provide a recycled hydrogen stream. The recycled hydrogen stream can be combined with a makeup hydrogen stream to provide the hydrogen stream for supplying to the reactor. Certain embodiments of the process further include the steps of: supplying the hydrodearylated aromatic bottoms to a distillation unit to provide a light fraction having monoaromatics and a heavy hydrodearylated aromatic bottoms fraction having heavy alkyl aromatics and multiaromatics.

The Hildebrand solubility (HSB) parameter provides a numerical estimate of the degree of solubility between materials. The HSB parameter is derived from the cohesive energy density of the solvent, and can be expressed in units of $MPa^{1/2}$. HSB parameters for various solvents are tabulated in Table 1.

TABLE 1

Hildebrand Solubility Parameters of Solvents.

| Solvent | δ ($MPa^{1/2}$) |
|---|---|
| Heptane | 15.3 |
| n-Dodecane | 16.0 |
| Benzene | 18.7 |
| Kerosene | 16.3 |
| Light gas oil | 15.7 |
| Aromatic bottoms (full range) | 20.7 |
| Aromatic bottoms (boiling above 180° C.) | 21.2 |

As shown in Table 1, both the full-range aromatic bottoms and the fraction boiling above 180° C. have elevated HSB parameters, 20.7 $MPa^{1/2}$ and 21.2 $MPa^{1/2}$ respectively. Heavier fractions of aromatic bottoms would be expected to have greater HSB parameters. Mixtures substantially composed of aromatic bottoms or a heavy aromatic bottoms fraction would be expected to have similar HSB parameters. Aromatic blending components composed, at least in part, of aromatic bottoms can have suitable blending properties for use as a fuel oil component. In various embodiments, the aromatic blending component has an HSB parameter of at least about 16.0 $MPa^{1/2}$, at least about 18.0 $MPa^{1/2}$, at least about 20.0 $MPa^{1/2}$, at least about 21.0 $MPa^{1/2}$, and at least about 22.0 $MPa^{1/2}$ in some embodiments.

An embodiment of a process for producing a fuel oil having an aromatic blending component includes the steps of: supplying an aromatic feedstock; processing the aromatic feedstock in an aromatic recovery complex to produce aromatic products and aromatic bottoms; producing an aromatic blending component from the aromatic bottoms; and blending the aromatic blending component with one or more bulk fuel oil components to produce a fuel oil.

In the step of supplying an aromatic feedstock, the feedstock can be straight-run naphtha, pyrolysis gas, or coke-oven light oil. In certain embodiments, the feedstock is a fraction of crude oil boiling in the range of about 36-180° C. In certain embodiments, the feedstock can be hydrotreated to reduce sulfur and nitrogen content to less than about 0.5 parts per million by weight (ppmw). In certain embodiments, the feedstock can be reformed. In certain embodiments, the feedstock can be reformed by catalytic reforming to produce aromatic compounds.

In certain embodiments, the step of processing the aromatic feedstock in an aromatic recovery complex to produce aromatic products and aromatic bottoms includes: splitting the aromatic feedstock into a light reformate stream having $C_5$ and $C_6$ hydrocarbons and a heavy reformate stream having $C_{7+}$ hydrocarbons; extracting benzene from the light reformate stream to produce a benzene product stream having benzene and to recover substantially benzene-free gasoline in a raffinate motor gasoline (mogas) stream including gasoline; splitting the heavy reformate stream to produce a $C_7$ cut mogas stream including gasoline and a $C_{8+}$ hydrocarbon stream having $C_{8+}$ hydrocarbons; treating the $C_{8+}$ hydrocarbon stream in a clay tower, in which olefinic compounds react with alkyl aromatics to produce $C_{16+}$ alkylated noncondensed multiaromatics; separating the $C_{8+}$ hydrocarbon stream in a xylene rerun unit to produce a $C_8$ hydrocarbon stream having $C_8$ hydrocarbons and a $C_{9+}$ hydrocarbon stream having $C_{9+}$ hydrocarbons; extracting p-xylene from the $C_8$ hydrocarbon stream in a p-xylene extraction unit to produce a p-xylene product stream having p-xylene, a mixed xylene stream including other xylene isomers, and a $C_7$ cut mogas stream including gasoline; converting other xylene isomers from the mixed xylene stream into p-xylene in a xylene isomerization unit to produce a converted xylene stream including p-xylene and other $C_{8+}$ hydrocarbons; splitting the converted xylene stream to produce a $C_{7-}$ hydrocarbon stream including $C_{7-}$ hydrocarbons and a $C_{8+}$ converted xylene stream including p-xylene and other $C_{8+}$ hydrocarbons; recycling the $C_{7-}$ hydrocarbon streams to the aromatic feedstock and recycling the $C_{8+}$ converted xylene stream to the xylene rerun unit. In certain embodiments, the $C_{9+}$ hydrocarbon stream from the xylene rerun unit is aromatic bottoms.

In certain embodiments, the step of producing an aromatic blending component from the aromatic bottoms includes using straight-run (unprocessed) aromatic bottoms as an aromatic blending component. When aromatic bottoms is used as an aromatic blending component, the aromatic bottoms can be used neat or in combination. In certain embodiments, the aromatic blending component includes heavy alkyl aromatics and alkyl-bridged noncondensed and condensed multiaromatic compounds from aromatic bottoms. In certain embodiments, the aromatic blending component includes condensed multiaromatic compounds.

In certain embodiments, the step of producing an aromatic blending component from the aromatic bottoms includes fractionating the aromatic bottoms to obtain heavy aromatic bottoms and using the heavy aromatic bottoms as an aromatic blending component. In certain embodiments, the heavy aromatic bottoms includes hydrocarbons with an initial boiling point above 180° C. In certain embodiments, the heavy aromatic bottoms includes $C_{11+}$ hydrocarbons.

In certain embodiments, the step of producing an aromatic blending component from the aromatic bottoms includes hydrodearylating the aromatic bottoms to produce hydrodearylated aromatic bottoms. The hydrodearylated aromatic bottoms are then fractionated to produce a heavy hydrodearylated aromatic bottoms fraction having heavy hydrodearylated aromatic bottoms, the aromatic blending component including the heavy hydrodearylated aromatic bottoms.

In certain embodiments, the step of producing an aromatic blending component from the aromatic bottoms includes fractionating the aromatic bottoms to obtain heavy aromatic bottoms, hydrodearylating the heavy aromatic bottoms to produce hydrodearylated aromatic bottoms, and fractionating the hydrodearylated aromatic bottoms to obtain heavy hydrodearylated aromatic bottoms; the aromatic blending component including the heavy hydrodearylated aromatic bottoms. In certain embodiments, the heavy aromatic bottoms includes hydrocarbons with an initial boiling point above about 180° C. In certain embodiments, the heavy aromatic bottoms includes $C_{11+}$ hydrocarbons. In certain embodiments, the heavy hydrodearylated aromatic bottoms includes hydrocarbons with an initial boiling point above about 180° C. In certain embodiments, the heavy hydrodearylated aromatic bottoms includes a fraction that substantially consists of $C_{11+}$ hydrocarbons.

In certain embodiments, the step of producing an aromatic blending component from the aromatic bottoms includes using a combination of straight-run aromatic bottoms, heavy aromatic bottoms, or heavy hydrodearylated aromatic bottoms as an aromatic blending component. In certain embodiments, the aromatic blending component includes heavy alkyl monoaromatic hydrocarbons and multiaromatic hydrocarbons. In certain embodiments, the aromatic blending component has a Hildebrand solubility parameter at least about 16.0 $MPa^{1/2}$, at least about 18.0 $MPa^{1/2}$, at least about 20.0 $MPa^{1/2}$, at least about 21.0 $MPa^{1/2}$, and at least about 22.0 $MPa^{1/2}$ in some embodiments.

The step of blending the aromatic blending component with one or more fuel oil components to produce a fuel oil includes combining an aromatic blending component with one or more bulk fuel oil components to produce a fuel oil. In certain embodiments, the bulk fuel oil components can be vacuum residue oil, light gas oil, kerosene, FCC DCO, visbroken residues, and delayed coking liquids. The fuel oil of this disclosure can have reduced kerosene content in comparison with a conventional fuel oil; and in certain embodiments kerosene can be completely eliminated. In certain embodiments, the fuel oil can have increased vacuum oil residue content in comparison with a conventional fuel oil. In certain embodiments, vacuum residue oil includes at least about 50 vol % of the fuel oil blend, and at least about 60 vol % in some embodiments. In certain embodiments, the aromatic blending component includes about 0.1-10 vol % of the fuel oil, and in the range of about 0.1-5 vol % in some embodiments. In certain embodiments, the aromatic blending component includes less than about 15 vol % kerosene, and less than about 10 vol % in some embodiments.

FIG. 1 is a schematic diagram of an embodiment of a system and process for producing an aromatic blending component and a fuel oil having an aromatic blending component, where the aromatic blending component is straight-run aromatic bottoms. FIG. 1 illustrates a refinery with an aromatic complex. In refining system 100, a crude oil inlet stream 101 is fluidly coupled to atmospheric distillation unit 110, and crude oil from the crude oil inlet stream 101 is separated into naphtha stream 111, atmospheric residue stream 113, and diesel stream 112. Diesel stream 112 proceeds to a diesel hydrotreating unit (not shown), and naphtha stream 111 proceeds to naphtha hydrotreating unit 120. A hydrotreated naphtha stream 121 exits the naphtha hydrotreating unit 120 and enters catalytic naphtha reforming unit 130. A separated hydrogen stream 131 exits the naphtha reforming unit 130, and a reformate stream 132 also exits the naphtha reforming unit 130. A portion of reformate stream 132 enters aromatic recovery complex 140, and another portion of reformate stream 132 is separated by pool stream 133 to a gasoline pool. Aromatic recovery complex 140 separates the reformate from reformate stream 132 into pool stream 141, aromatic products stream 142, and aromatic bottoms stream 143. Pool stream 141 is sent to a gasoline pool.

The crude oil is distilled in atmospheric distillation unit 110 to recover naphtha, which boils in the range of about 36-180° C., and diesel, which boils in the range of about 180-370° C. An atmospheric residue fraction in atmospheric residue stream 113 boils at about 370° C. and above. Naphtha stream 111 is hydrotreated in the naphtha hydrotreating unit 120 to reduce the sulfur and nitrogen content to less than about 0.5 ppmw, and the hydrotreated naphtha stream 121 is sent to naphtha reforming unit 130 to improve its quality, or in other words increase the octane number to produce gasoline blending stream or feedstock for an aromatics recovery unit. An atmospheric residue fraction is either used as a fuel oil component or sent to other separation or conversion units to convert heavy hydrocarbons to valuable products. Reformate stream 132 from naphtha reforming unit 130 can be used as a gasoline blending component or sent to an aromatic complex, such as aromatic recovery complex 140, to recover valuable aromatics, such as benzene, toluene and xylenes.

In certain embodiments, aromatic recovery complex 140 includes processes to recover benzene, toluene, and the particular isomer p-xylene. Reformate stream 132 is split by a reformate splitter into two fractions: a light reformate stream with $C_5$ and $C_6$ hydrocarbons, and a heavy reformate stream with $C_{7+}$ hydrocarbons. The light reformate stream is sent to a benzene extraction unit to extract benzene as a benzene product stream, and to recover substantially benzene-free gasoline in a raffinate mogas stream. The heavy reformate stream is split by a reformate splitter to produce a $C_7$ cut mogas stream and a $C_{8+}$ hydrocarbon stream. The $C_{8+}$ hydrocarbon stream is treated in a clay tower. A xylene rerun unit separates the $C_{8+}$ hydrocarbons in the $C_{8+}$ hydrocarbon stream into a $C_8$ hydrocarbon stream and a $C_{9+}$ hydrocarbon stream. The $C_8$ hydrocarbon stream proceeds to a p-xylene extraction unit to recover p-xylene in a p-xylene product stream. The p-xylene extraction unit also produces a $C_7$ cut mogas stream. Other xylenes are recovered and sent to a xylene isomerization unit to be converted into p-xylene. The isomerized xylenes are split to produce a top stream and a bottom stream including converted isomers. The top stream is recycled to the reformate splitter. The bottom stream is recycled to the xylene rerun unit where the converted fraction is separated and sent back to the p-xylene extraction unit. The heavy fraction from the xylene rerun unit is recovered as process reject or aromatic bottoms.

An aromatic bottoms stream 143 including aromatic bottoms exits the aromatic recovery complex 140 and is sent to a fuel oil blending unit 500. In certain embodiments, aromatic bottoms stream 143 includes straight-run aromatic bottoms. A bulk fuel oil component inlet stream 501 delivers bulk fuel oil components to the fuel oil blending unit 500. In certain embodiments, bulk fuel oil components can include vacuum gas oil, light gas oil, kerosene, FCC DCO, visbroken residues, and delayed coking liquids. In this embodiment, the aromatic blending component, aromatic bottoms from aromatic bottoms stream 143, is blended with the bulk fuel oil components from the bulk fuel oil component inlet stream 501 to produce a fuel oil blend stream 502 including a fuel oil.

Figure 2:
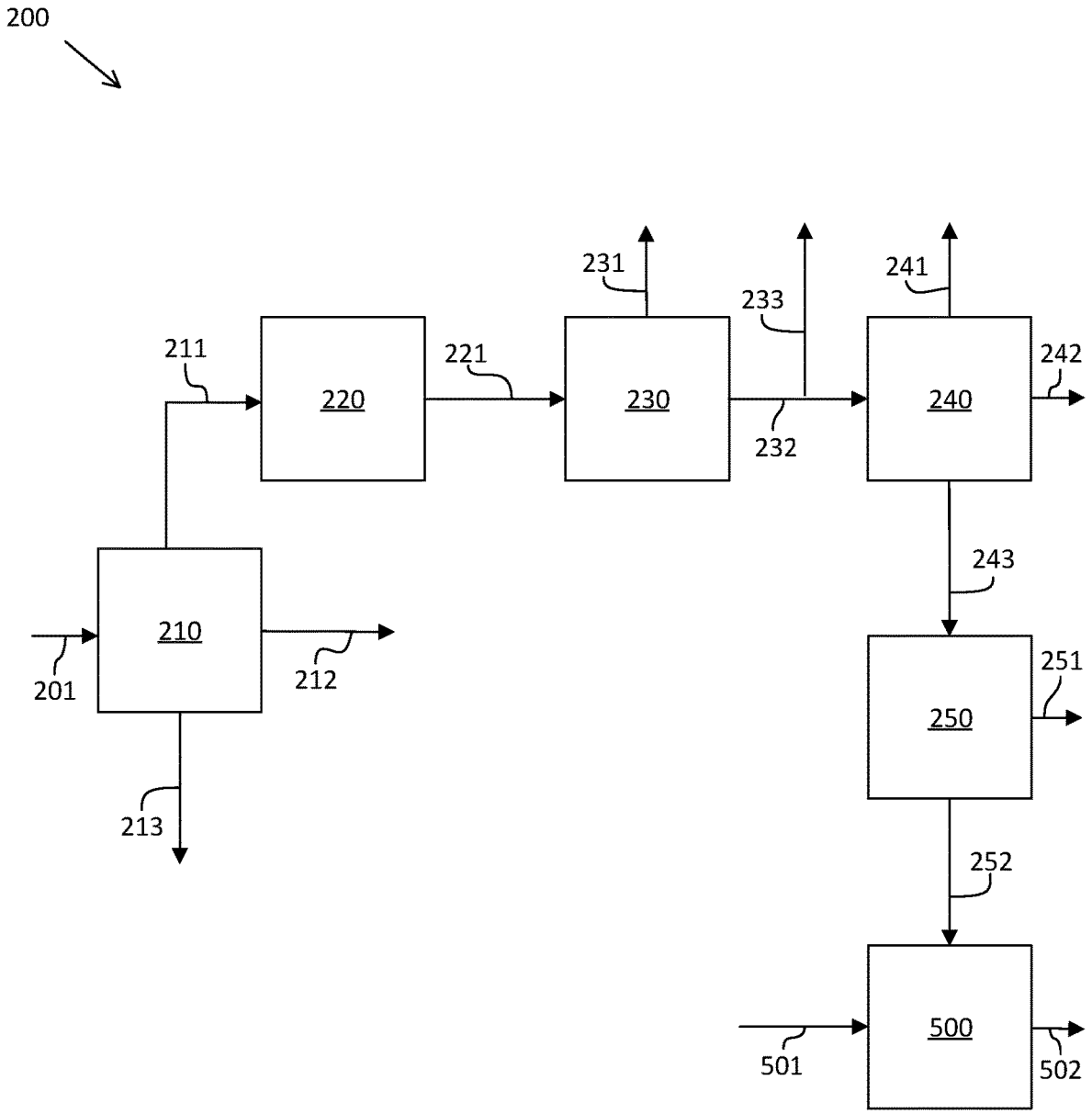
FIG. 2 is a schematic diagram of a process that produces and uses a heavy aromatic bottoms as an aromatic blending component.

FIG. 2 is a schematic diagram of an embodiment of a system and process for producing an aromatic blending component and a fuel oil having an aromatic blending component, where the aromatic blending component is heavy aromatic bottoms. FIG. 2 illustrates a refinery with an aromatic complex. In refining system 200, a crude oil inlet stream 201 is fluidly coupled to atmospheric distillation unit 210, and crude oil from the crude oil inlet stream 201 is separated into naphtha stream 211, atmospheric residue stream 213, and diesel stream 212. Diesel stream 212 proceeds to a diesel hydrotreating unit (not shown), and naphtha stream 211 proceeds to naphtha hydrotreating unit 220. A hydrotreated naphtha stream 221 exits the naphtha hydrotreating unit 220 and enters catalytic naphtha reforming unit 230. A separated hydrogen stream 231 exits the naphtha reforming unit 230, and a reformate stream 232 also exits the naphtha reforming unit 230. A portion of reformate stream 232 enters aromatic recovery complex 240, and another portion of reformate stream 232 is separated by pool stream 233 to a gasoline pool. Aromatic recovery complex 240 separates the reformate from reformate stream 232 into pool stream 241, aromatic products stream 242, and aromatic bottoms stream 243. Pool stream 241 is sent to a gasoline pool.

The crude oil is distilled in atmospheric distillation unit 210 to recover naphtha, which boils in the range of about 36-180° C., and diesel, which boils in the range of about 180-370° C. An atmospheric residue fraction in atmospheric residue stream 213 boils at about 370° C. and above. Naphtha stream 211 is hydrotreated in the naphtha hydrotreating unit 220 to reduce the sulfur and nitrogen content to less than about 0.5 ppmw, and the hydrotreated naphtha stream 221 is sent to naphtha reforming unit 230 to improve its quality, or in other words increase the octane number to produce gasoline blending stream or feedstock for an aromatics recovery unit. An atmospheric residue fraction is either used as a fuel oil component or sent to other separation or conversion units to convert heavy hydrocarbons to valuable products. Reformate stream 232 from naphtha reforming unit 230 can be used as a gasoline blending component or sent to an aromatic complex, such as aromatic recovery complex 240, to recover valuable aromatics, such as benzene, toluene and xylenes.

In certain embodiments, aromatic recovery complex 240 includes systems and processes for recovering benzene, toluene, and the particular isomer p-xylene. Aromatic recovery complex 240 can be operated similar to the description of aromatic recovery complex 140.

An aromatic bottoms stream 243 including aromatic bottoms exits the aromatic recovery complex 240 and is sent to an atmospheric distillation unit 250. The atmospheric distillation unit 250 fractionates the aromatic bottoms to produce a light bottoms product stream 251 including light bottoms, and a heavy aromatic bottoms stream 252 including heavy aromatic bottoms. In certain embodiments, the light bottoms fraction boils at a temperature in the range of about 36-180° C., and the heavy aromatic bottoms boils at a temperature above 180° C. The light bottoms product stream 251 is sent directly to a gasoline pool as a gasoline blending component, or the $C_9$ and $C_{10}$ hydrocarbons can be removed and sent as feedstock to a transalkylation unit. The heavy aromatic bottoms stream 252 is sent to a fuel oil blending unit 500. A bulk fuel oil component inlet stream 501 delivers bulk fuel oil components to the fuel oil blending unit 500. In certain embodiments, bulk fuel oil components can include vacuum gas oil, light gas oil, kerosene, FCC DCO, visbroken residues, and delayed coking liquids. In this embodiment, the aromatic blending component, heavy aromatic bottoms from heavy aromatic bottoms stream 252, is blended with the bulk fuel oil components from the bulk fuel oil component inlet stream 501 to produce a fuel oil blend stream 502 including a fuel oil.

Figure 3:
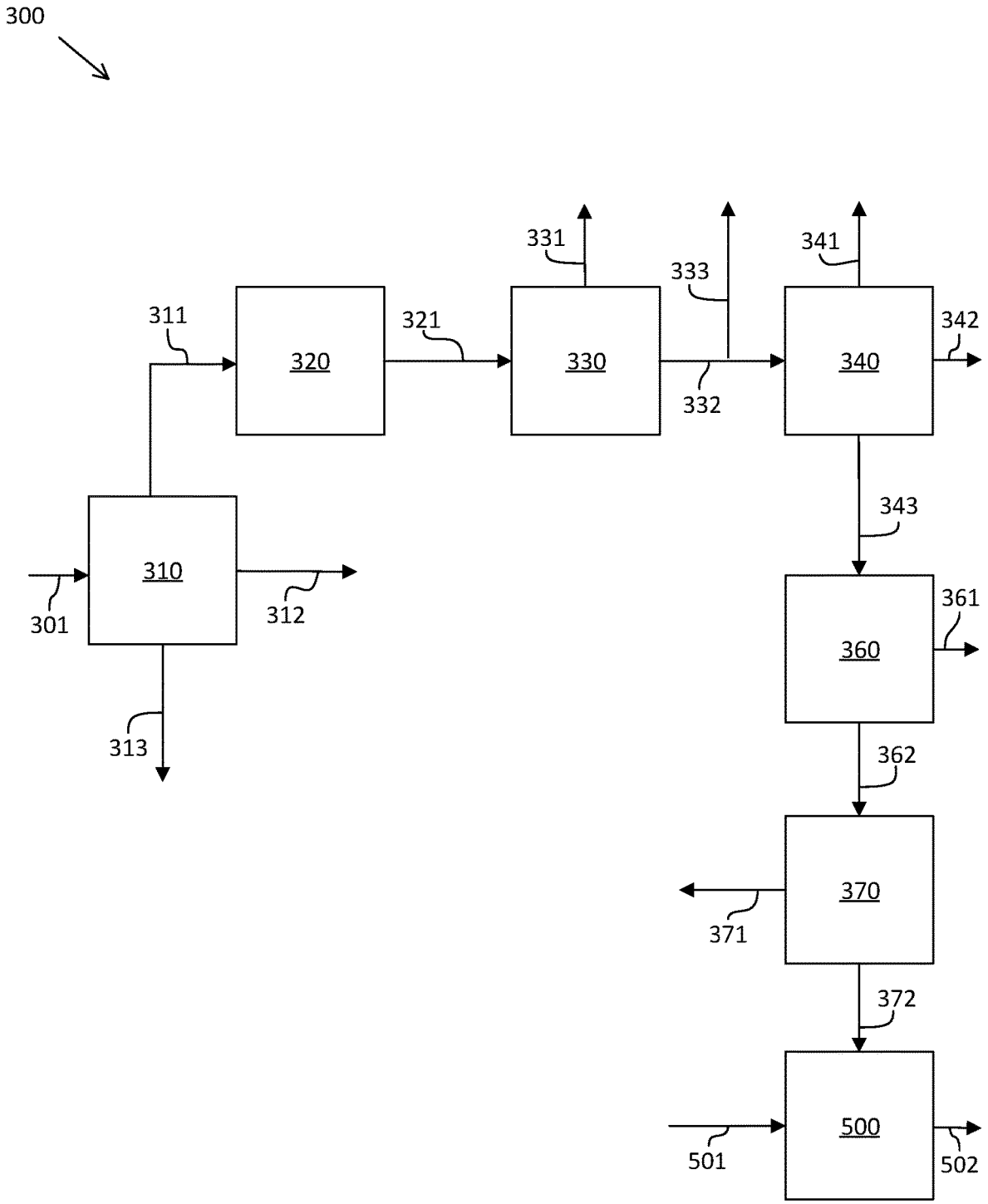
FIG. 3 is a schematic diagram of a process that produces and uses a heavy hydrodearylated aromatic bottoms as an aromatic blending component.

FIG. 3 is a schematic diagram of an embodiment of a system and process for producing an aromatic blending component and a fuel oil having an aromatic blending component, where the aromatic blending component is heavy hydrodearylated aromatic bottoms. FIG. 3 illustrates a refinery with an aromatic complex. In refining system 300, a crude oil inlet stream 301 is fluidly coupled to atmospheric distillation unit 310, and crude oil from the crude oil inlet stream 301 is separated into naphtha stream 311, atmospheric residue stream 313, and diesel stream 312. Diesel stream 312 proceeds to a diesel hydrotreating unit (not shown), and naphtha stream 311 proceeds to naphtha hydrotreating unit 320. A hydrotreated naphtha stream 321 exits the naphtha hydrotreating unit 320 and enters catalytic naphtha reforming unit 330. A separated hydrogen stream 331 exits the catalytic naphtha reforming unit 330, and a reformate stream 332 also exits the catalytic naphtha reforming unit 330. A portion of reformate stream 332 enters aromatic recovery complex 340, and another portion of reformate stream 332 is separated by pool stream 333 to a gasoline pool. Aromatic recovery complex 340 separates the reformate from reformate stream 332 into pool stream 341, aromatic products stream 342, and aromatic bottoms stream 343. The pool stream 341 is sent to a gasoline pool.

The crude oil is distilled in atmospheric distillation unit 310 to recover naphtha, which boils in the range of about 36-180° C., and diesel, which boils in the range of about 180-370° C. An atmospheric residue fraction in atmospheric residue stream 313 boils at about 370° C. and above. Naphtha stream 311 is hydrotreated in the naphtha hydrotreating unit 320 to reduce the sulfur and nitrogen content to less than about 0.5 ppmw, and the hydrotreated naphtha stream 321 is sent to catalytic naphtha reforming unit 330 to improve its quality, or in other words increase the octane number to produce gasoline blending stream or feedstock for an aromatics recovery unit. An atmospheric residue fraction is either used as a fuel oil component or sent to other separation or conversion units to convert heavy hydrocarbons to valuable products. Reformate stream 332 from catalytic naphtha reforming unit 330 can be used as a gasoline blending component or sent to an aromatic complex, such as aromatic recovery complex 340, to recover valuable aromatics, such as benzene, toluene and xylenes.

In certain embodiments, aromatic recovery complex 340 includes systems and processes for recovering benzene, toluene, and the particular isomer p-xylene. Aromatic recovery complex 340 can be operated similar to the description of aromatic recovery complex 140.

An aromatic bottoms stream 343 including aromatic bottoms exits the aromatic recovery complex 340 and is sent to hydrodearylation unit 360. The hydrodearylation unit converts heavy alkyl aromatic compounds and alkyl-bridged noncondensed alkyl multiaromatic compounds into lighter alkyl monoaromatic compounds. Hydrogen produced in the hydrodearylation process leaves in hydrogen stream 361. In some embodiments, hydrogen stream 361 includes at least about 95 vol % hydrogen. Light hydrocarbons such as methane, ethane, propane, and butane can be present in small amounts (that is, less than about 5 vol %) in hydrogen stream 361. The hydrodearylation unit produces a hydrodearylated aromatic bottoms stream 362 including heavy hydrodearylated aromatic bottoms; where the heavy hydrodearylated aromatic bottoms includes light alkyl monoaromatic compounds, heavy alkyl aromatic compounds, and multiaromatic compounds. The hydrodearylated aromatic bottoms stream 362 is sent to an atmospheric distillation unit 370, where it is fractionated to obtain a light hydrodearylated aromatic bottoms stream 371 including light alkyl monoaromatics, and a heavy hydrodearylated aromatic bottoms fraction 372 including heavy hydrodearylated aromatic bottoms. In certain embodiments, the light hydrodearylated aromatic bottoms boils at a temperature in the range of about 36-180° C., and the heavy hydrodearylated aromatic bottoms boils at a temperature above 180° C. The light hydrodearylated aromatic bottoms stream 371 can be processed downstream for use as a gasoline blending component or as a feedstock for petrochemicals. The heavy hydrodearylated aromatic bottoms fraction 372 is sent to a fuel oil blending unit 500. A bulk fuel oil component inlet stream 501 delivers bulk fuel oil components to the fuel oil blending unit 500. In certain embodiments, bulk fuel oil components can include vacuum gas oil, light gas oil, kerosene, FCC DCO, visbroken residues, and delayed coking liquids. In this embodiment, the aromatic blending component, heavy hydrodearylated aromatic bottoms from heavy hydrodearylated aromatic bottoms fraction 372, is blended with the bulk fuel oil components from the bulk fuel oil component inlet stream 501 to produce a fuel oil blend stream 502 including a fuel oil.

Figure 4:
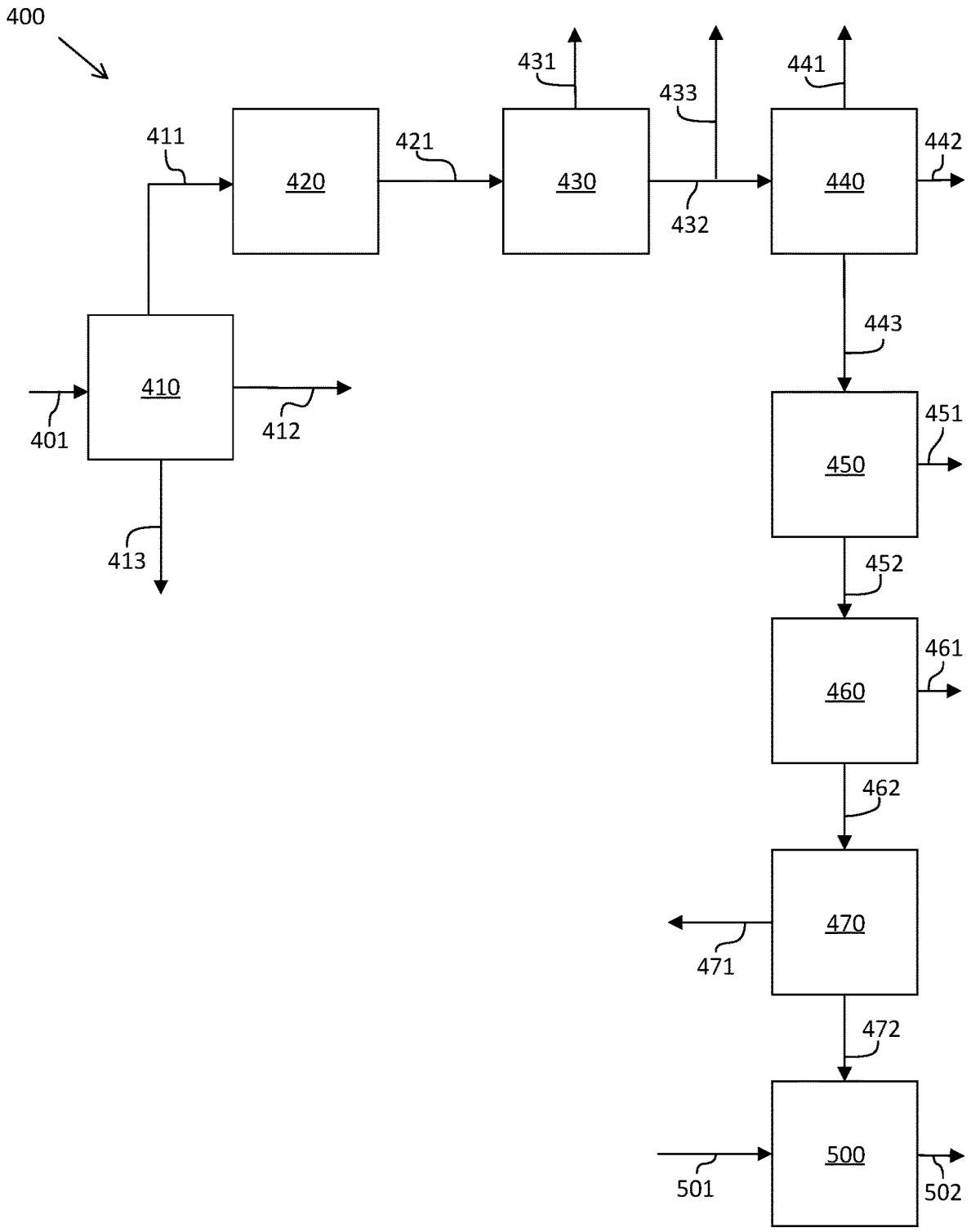
FIG. 4 is a schematic diagram of a process that produces and uses a heavy hydrodearylated aromatic bottoms as an aromatic blending component.

FIG. 4 is a schematic diagram of an embodiment of a system and process for producing an aromatic blending component and a fuel oil having an aromatic blending component, where the aromatic blending component is heavy hydrodearylated aromatic bottoms. FIG. 4 illustrates a refinery with an aromatic complex. In refining system 400, a crude oil inlet stream 401 is fluidly coupled to atmospheric distillation unit 410, and crude oil from the crude oil inlet stream 401 is separated into naphtha stream 411, atmospheric residue stream 413, and diesel stream 412. Diesel stream 412 proceeds to a diesel hydrotreating unit (not shown), and naphtha stream 411 proceeds to naphtha hydrotreating unit 420. A hydrotreated naphtha stream 421 exits the naphtha hydrotreating unit 420 and enters catalytic naphtha reforming unit 430. A separated hydrogen stream 431 exits the catalytic naphtha reforming unit 430, and a reformate stream 432 also exits the naphtha reforming unit 430. A portion of reformate stream 432 enters aromatic recovery complex 440, and another portion of reformate stream 432 is separated by pool stream 433 to a gasoline pool. Aromatic recovery complex 440 separates the reformate from reformate stream 432 into pool stream 441, aromatic products stream 442, and aromatic bottoms stream 443. Pool stream 441 is sent to a gasoline pool.

The crude oil is distilled in atmospheric distillation unit 410 to recover naphtha, which boils in the range of about 36-180° C., and diesel, which boils in the range of about 180-370° C. An atmospheric residue fraction in atmospheric residue stream 413 boils at about 370° C. and above. Naphtha stream 411 is hydrotreated in the naphtha hydrotreating unit 420 to reduce the sulfur and nitrogen content to less than about 0.5 ppmw, and the hydrotreated naphtha stream 421 is sent to naphtha reforming unit 430 to improve its quality, or in other words increase the octane number to produce gasoline blending stream or feedstock for an aromatics recovery unit. An atmospheric residue fraction is either used as a fuel oil component or sent to other separation or conversion units to convert heavy hydrocarbons to valuable products. Reformate stream 432 from naphtha reforming unit 430 can be used as a gasoline blending component or sent to an aromatic complex, such as aromatic recovery complex 440, to recover valuable aromatics, such as benzene, toluene and xylenes.

In certain embodiments, aromatic recovery complex 440 includes systems and processes for recovering benzene, toluene, and the particular isomer p-xylene. Aromatic recovery complex 440 can be operated similar to aromatic recovery complex 140.

An aromatic bottoms stream 443 including aromatic bottoms exits the aromatic recovery complex 440 and is sent to an atmospheric distillation unit 450. The aromatic bottoms are fractionated in the atmospheric distillation unit 450 to produce a light bottoms product stream 451 including light bottoms product, and a heavy aromatic bottoms stream 452 including heavy aromatic bottoms. In certain embodiments, the light bottoms product includes a fraction that boils at a temperature in the range of about 36-180° C., and the heavy aromatic bottoms includes a fraction that boils at a temperature above about 180° C. In certain embodiments, the light bottoms product includes $C_9$ and $C_{10}$ compounds, and the heavy aromatic bottoms includes $C_{11+}$ compounds. In certain embodiments, the light bottoms product stream 451 can be sent directly to a gasoline pool as a gasoline blending component. In certain embodiments, the light bottoms product stream 451 can be sent directly to a transalkylation unit as feedstock for the production of petrochemicals.

The heavy aromatic bottoms stream 452 is sent to hydrodearylation unit 460. The hydrodearylation unit converts heavy alkyl aromatic compounds and alkyl-bridged noncondensed alkyl multiaromatic compounds into lighter alkyl monoaromatic compounds. Hydrogen produced in the hydrodearylation process leaves in hydrogen stream 461. In some embodiments, hydrogen stream 461 includes at least about 95 vol % hydrogen. Light hydrocarbons such as methane, ethane, propane, and butane can be present in small amounts (that is, less than about 5 vol %) in hydrogen stream 461. The hydrodearylation unit produces a hydrodearylated aromatic bottoms stream 462 including heavy hydrodearylated aromatic bottoms; where the heavy hydrodearylated aromatic bottoms includes light alkyl monoaromatic compounds, heavy alkyl aromatic compounds, and multiaromatic compounds.

The hydrodearylated aromatic bottoms stream 462 is sent to atmospheric distillation unit 470, where it is fractionated to obtain a light hydrodearylated aromatic bottoms stream 471 including light alkyl monoaromatics, and a heavy hydrodearylated aromatic bottoms fraction 472 including heavy hydrodearylated aromatic bottoms. In certain embodiments, the light hydrodearylated aromatic bottoms boils at a temperature in the range of about 36-180° C., and the heavy hydrodearylated aromatic bottoms boils at a temperature above 180° C. In certain embodiments, the light hydrodearylated aromatic bottoms includes $C_9$ and $C_{10}$ compounds, and the heavy hydrodearylated aromatic bottoms includes $C_{11+}$ compounds. The light hydrodearylated aromatic bottoms stream 471 can be processed downstream for use as a gasoline blending component or as a feedstock for petrochemicals.

The heavy hydrodearylated aromatic bottoms fraction 472 is sent to fuel oil blending unit 500. A bulk fuel oil component inlet stream 501 delivers bulk fuel oil components to the fuel oil blending unit 500. In certain embodiments, bulk fuel oil components can include vacuum gas oil, light gas oil, kerosene, FCC DCO, visbroken residues, and delayed coking liquids. In this embodiment, the aromatic blending component, heavy hydrodearylated aromatic bottoms from heavy hydrodearylated aromatic bottoms fraction 472, is blended with the bulk fuel oil components from the bulk fuel oil component inlet stream 501 to produce a fuel oil blend stream 502 including a fuel oil.

Figure 5:
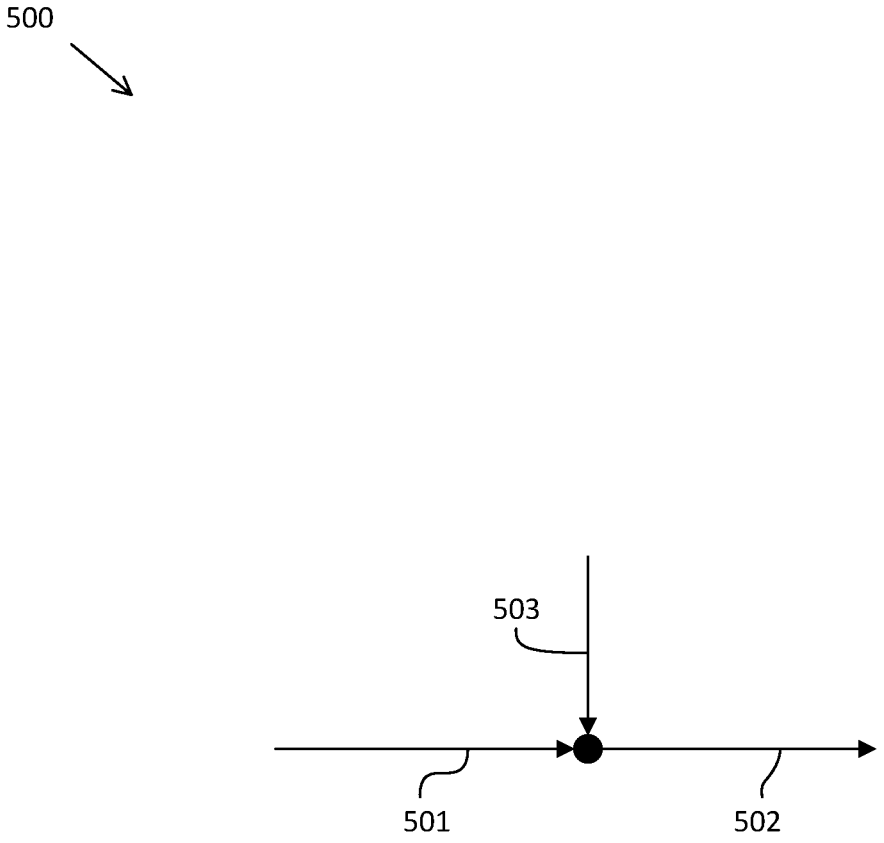
FIG. 5 is a schematic diagram of a blending process.

FIG. 5 is a schematic diagram of a fuel oil blending unit and process for blending an aromatic blending component with bulk fuel oil blending components to produce a fuel oil. In the fuel oil blending unit 500, an aromatic blending component stream 503 is blended a with bulk fuel oil component inlet stream 501 to produce a fuel oil blend stream 502. The aromatic blending component stream 503 includes an aromatic blending component derived from the aromatic bottoms of an aromatic recovery complex. In certain embodiments, the aromatic blending component stream 503 can include a straight-run aromatic bottoms stream 143, heavy aromatic bottoms stream 252, heavy hydrodearylated aromatic bottoms fraction 372, or a heavy hydrodearylated aromatic bottoms fraction 472. In certain embodiments, the bulk fuel oil component inlet stream 501 can include vacuum residue oil, light gas oil, kerosene, FCC DCO, visbroken residues, and delayed coking liquids.

EXAMPLES

The following illustrative examples are intended to be non-limiting.

Example 1

The properties of certain aromatic-bottoms-derived hydrocarbon fractions were calculated. In this example a 5.5143 kg sample of aromatic bottoms was distilled using a lab-scale true boiling point distillation column with fifteen or more theoretical plates using ASTM method D2917. About 57 wt % of the sample was a light aromatic bottoms with an initial boiling point in the range of 36-180° C. The remaining 43 wt % of the sample was heavy aromatic bottoms with an initial boiling point above about 180° C. The straight-run aromatic bottoms were hydrodearylated in a reactor at a temperature in the range of about 280-340° C., pressure in the range of about 15-30 bar, and with a liquid hourly space velocity of about 1.7 $hr^{-1}$. Properties for the straight-run aromatic bottoms, light aromatic bottoms, heavy aromatic bottoms, and hydrodearylated aromatic bottoms are shown in Table 2.

TABLE 2

Properties of sample straight-run aromatic bottoms, light aromatic bottoms, heavy aromatic bottoms, and hydrodearylated aromatic bottoms.

| Property | Straight-run Aromatic Bottoms | Light Fraction | Heavy Aromatic Bottoms Fraction | Hydrodearylated Aromatic Bottoms |
|---|---|---|---|---|
| Density | 0.9125 | 0.8730 | 0.9226 | 0.8804 |
| Octane number, ASTM D2799 | — | 107 | — | — |
| Derived cetane index, ASTM D8690 | — | — | 16 | — |
| Initial boiling point, ° C. | 182 | 153 | 163 | 114 |
| 10 wt % | 183 | 162 | 167 | 154 |
| 30 wt % | 184 | 163 | 196 | 159 |
| 50 wt % | 207 | 169 | 221 | 168 |
| 70 wt % | 302 | 171 | 258 | 177 |
| 90 wt % | 330 | 184 | 336 | 209 |
| Final boiling point, ° C. | 350 | 251 | 351 | 330 |
| Paraffins | 1.0 | 0.2 | — | 1.3 |
| Mono-Naphthenes | 0.0 | 0.0 | — | 0.0 |
| Di-naphthenes | 0.0 | 0.0 | — | 0.0 |
| Mono Aromatics | 74.6 | 99.0 | — | 90.2 |
| Naphtheno Mono Aromatics | 3.1 | 0.8 | — | 3.2 |
| Diaromatics | 15.4 | 0.0 | — | 4.2 |
| Naphtheno Di Aromatics | 5.2 | 0.0 | — | 0.9 |
| Tri Aromatics | 0.7 | 0.0 | — | 0.2 |

Example 2

The properties of certain aromatic-bottoms-derived hydrocarbon fractions were determined by simulating distillation of a 7.97 kg sample of aromatic bottoms using a lab-scale true boiling point distillation column with fifteen or more theoretical plates using ASTM method D2917. About 83 wt % of the sample was a light bottoms product with an initial boiling point in the range of about 36-180° C. The remaining 17 wt % of the sample was a heavy aromatic bottoms fraction with an initial boiling point above about 180° C. The straight-run aromatic bottoms were hydrodearylated in a reactor at about 350° C., about 15 bar, and a liquid hourly space velocity of about 1.7 $hr^{-1}$. In certain embodiments, the straight-run aromatic bottoms, heavy aromatic bottoms fraction, and hydrodearylated aromatic bottoms are used as aromatic blending components. Properties for the straight-run aromatic bottoms, light fraction, heavy fraction, and hydrodearylated aromatic bottoms are shown in Table 3.

TABLE 3

Properties of sample straight-run aromatic bottoms, light aromatic bottoms, heavy aromatic bottoms, and hydrodearylated aromatic bottoms.

| Property | Straight-run Aromatic Bottoms | Light Fraction | Heavy Aromatic Bottoms Fraction | Hydrodearylated Aromatic Bottoms |
|---|---|---|---|---|
| Density | 0.8834 | 0.8752 | 0.9181 | 0.8800 |
| Octane number, ASTM D2799 | — | 108 | — | — |
| Derived cetane index, ASTM D8690 | — | — | 12 | — |
| Initial boiling point, ° C. | 153 | 154 | 163 | 112 |
| 10 wt % | 163 | 164 | 190 | 163 |
| 30 wt % | 166 | 166 | 202 | 166 |
| 50 wt % | 172 | 171 | 231 | 172 |
| 70 wt % | 175 | 174 | 289 | 174 |
| 90 wt % | 191 | 183 | 324 | 191 |
| Final boiling point, ° C. | 337 | 204 | 359 | 278 |
| Paraffins | 0.13 | 0.10 | — | 0.21 |
| Mono-Naphthenes | 0.13 | 0.00 | — | 0.32 |
| Di-naphthenes | 0.11 | 0.00 | — | 0.16 |
| Mono Aromatics | 92.57 | 99.9 | — | 94.53 |
| Naphtheno Mono Aromatics | 1.61 | 0.00 | — | 2.13 |
| Diaromatics | 4.64 | 0.00 | — | 2.06 |
| Naphtheno Di Aromatics | 0.49 | 0.00 | — | 0.36 |
| Tri Aromatics | 0.33 | 0.00 | — | 0.23 |

Example 3

A fuel oil blend including vacuum residue oil, FCC DCO, light gas oil, and kerosene (Blend 1) was studied. Blend 1 did not have an aromatic blending component. Properties of the blending components in Blend 1 are shown in Table 4-A, and the composition of Blend 1 is shown in Table 4-B. Only enough kerosene and light gas oil was added so that Blend 1 would comply with fuel oil specifications. Table 4-C shows that about 10.5 vol % of kerosene and about 24 vol % of light gas oil is necessary to make the fuel oil meet specifications. Properties of Blend 1 are shown in Table 4-C.

TABLE 4-A

Properties of bulk fuel oil components and straight-run aromatic bottoms.

| Properties | Kerosene | Light gas oil | Vacuum residue oil | FCC DCO | Straight-run Aromatic Bottoms |
|---|---|---|---|---|---|
| Specific Gravity at 15/15° C. | 0.817 | 0.851 | 1.034 | 1.053 | 0.923 |
| Sulfur wt % | 0.48 | 1.39 | 4.11 | 0.60 | 0.00 |
| Viscosity at 50° C., cSt | 0.539 | 3.085 | 39745.000 | 24.500 | 0.699 |

TABLE 4-A-continued

Properties of bulk fuel oil components and straight-run aromatic bottoms.

| Properties | Kerosene | Light gas oil | Vacuum residue oil | FCC DCO | Straight-run Aromatic Bottoms |
|---|---|---|---|---|---|
| Flash Point, ° C. | 85.00 | 104.44 | 376.67 | 376.67 | 45.00 |
| Micro carbon residue | 0.0 | 0.0 | 27.0 | 0.6 | 0.0 |
| Pour Point, ° C. | −50.0 | −12.2 | 49.0 | 24.0 | −70.0 |

TABLE 4-B

Example fuel oil blend compositions.

| Blend Component | Blend 1 vol % | Blend 2 vol % | Blend 3 vol % |
|---|---|---|---|
| Aromatic solvent | 0.0 | 2.0 | 6.0 |
| Kerosene | 10.5 | 8.5 | 0.0 |
| Light gas oil | 24.0 | 24.0 | 24.5 |
| Vacuum residue | 63.0 | 63.0 | 67.0 |
| FCC DCO | 2.5 | 2.5 | 2.5 |

TABLE 4-C

Properties of example blends with specification requirements.

| Properties/Fraction | Blend 1 | Blend 2 | Blend 3 | Specification |
|---|---|---|---|---|
| Specific Gravity at 15/15° C. | 0.968 | 0.970 | 0.979 | 0.979 max |
| Sulfur wt % | 2.98 | 2.98 | 3.10 | 3.70 max |
| Viscosity at 50° C., cSt | 73.367 | 75.492 | 160.314 | 380.000 max |
| Flash Point, ° C. | 160.1 | 111.6 | 76.0 | 65.5 min |
| Micro carbon residue | 17.0 | 17.0 | 18.1 | 20.0 max |
| Pour Point, ° C. | 22.9 | 22.9 | 22.9 | 24.0 max |

Example 4

A fuel oil blend including vacuum residue oil, FCC DCO, light gas oil, kerosene, and an aromatic blending component (Blend 2) was studied. The aromatic blending component was straight-run aromatic bottoms from an aromatic recovery complex. Only enough kerosene and light gas oil was added so that Blend 1 would comply with fuel oil specifications. Properties of the blending components are shown in Table 4-A, and the composition of Blend 2 is shown in Table 4-B. Comparing the composition of Blend 1 with the composition of Blend 2, the kerosene content of Blend 2 was reduced by about 2.0 vol % with the addition of about 2.0 vol % aromatic blending component. The substitution of an aromatic blending component for kerosene allows refineries to reserve valuable kerosene for sale on the market—a more economical use of kerosene. Properties of Blend 2 are shown in Table 4-C. Table 4-C shows that sulfur was not added by the addition of the straight-run aromatic bottoms, and that Blend 2 satisfies each of the fuel oil specifications.

In this example, and referring to FIG. 1, the aromatic bottoms stream 143 includes the straight-run aromatic bottoms. Referring to FIG. 5, the aromatic blending component stream 503 includes the straight-run aromatic bottoms, and the bulk fuel oil component inlet stream 501 includes the vacuum residue, light gas oil, kerosene, and FCC DCO. The aromatic blending component from aromatic blending component stream 503 is blended with the bulk fuel oil component from the bulk fuel oil component inlet stream 501 to produce a fuel oil blend stream 502 including a fuel oil blend.

Example 5

A fuel oil including vacuum residue oil, FCC DCO, light gas oil, and an aromatic blending component was studied (Blend 3). The aromatic blending component was straight-run aromatic bottoms from an aromatic recovery complex. Properties of the blending components are shown in Table 4-A, and the composition of Blend 3 is shown in Table 4-B. With the addition of about 6.0 vol % aromatic blending component, kerosene was surprisingly and unexpectedly eliminated entirely and the vacuum residue oil composition was increased by about 4.0 vol % in comparison with Blend 1. Properties of Blend 3 are shown in Table 4-C. The slight increase in sulfur content of Blend 3 in comparison with Blend 1 can be attributed to the increase in vacuum residue oil. Table 4-C shows that the aromatic blending component can be added in lieu of kerosene and that vacuum residue oil content can be increased while maintaining compliance with fuel oil specifications.

Example 6

The following example is provided to better illustrate an embodiment of a system and process for producing an aromatic blending component and a fuel oil; it should be considered exemplary, and does not limit the scope of the claimed system and process. In this example, referring to FIG. 1, crude oil is supplied to atmospheric distillation unit 110 by crude oil inlet stream 101. The crude oil is separated into naphtha stream 111 including naphtha boiling in the range of about 36-180° C., atmospheric residue stream 113 including atmospheric residue having an initial boiling point above about 370° C., and diesel stream 112 including diesel oil boiling in the range of about 180-370° C. Diesel stream 112 proceeds to a diesel hydrotreating unit (not shown) to desulfurize the diesel oil to less than about 10 ppm sulfur. Naphtha stream 111 is hydrotreated in naphtha hydrotreating unit 120. Hydrotreated naphtha stream 121 is treated to reduce sulfur and nitrogen content to less than about 0.5 ppmw. Hydrotreated naphtha stream 121 exits the naphtha hydrotreating unit 120 and enters catalytic naphtha reforming unit 130. The naphtha reforming unit 130 increases the octane number and produces feedstock for aromatic recovery complex 140. A separated hydrogen stream 131 exits the naphtha reforming unit 130, and a reformate stream 132 also exits the naphtha reforming unit 130. A portion of reformate stream 132 enters aromatic recovery complex 140, and another portion of reformate stream 132 is separated by pool stream 133 to a gasoline pool. Aromatic recovery complex 140 separates the reformate from reformate stream 132 into pool stream 141, aromatic products stream 142, and aromatic bottoms stream 143. The pool stream 141 is directed to a gasoline pool.

In the aromatic recovery complex 140, reformate stream 132 is split by a reformate splitter into two fractions: a light reformate stream with $C_5$ and $C_6$ hydrocarbons, and a heavy reformate stream with $C_{7+}$ hydrocarbons. The light reformate stream is sent to a benzene extraction unit to extract benzene as a benzene product stream, and to recover substantially benzene-free gasoline in a raffinate mogas stream. The heavy reformate stream is split by a reformate splitter to produce a $C_7$ cut mogas stream and a $C_{8+}$ hydrocarbon stream. The $C_{8+}$ hydrocarbon stream is treated in a clay tower. A xylene rerun unit separates the $C_{8+}$ hydrocarbons in the $C_{8+}$ hydrocarbon stream into a $C_8$ hydrocarbon stream and a $C_{9+}$ hydrocarbon stream. The $C_8$ hydrocarbon stream proceeds to a p-xylene extraction unit to recover p-xylene in a p-xylene product stream. The p-xylene extraction unit also produces a $C_7$ cut mogas stream. Other xylenes are recovered and sent to a xylene isomerization unit to be converted into p-xylene. The isomerized xylenes are split to produce a top stream and a bottom stream including converted isomers. The top stream is recycled to the reformate splitter. The bottom stream is recycled to the xylene rerun unit where the converted fraction is separated and sent back to the p-xylene extraction unit. The heavy fraction from the xylene rerun unit is recovered as process reject or aromatic bottoms.

Aromatic bottoms stream 143 including straight-run aromatic bottoms exits the aromatic recovery complex 140 and is sent to fuel oil blending unit 500. In fuel oil blending unit 500, an aromatic blending component including straight-run aromatic bottoms from aromatic bottoms stream 143 is blended with bulk fuel oil components including vacuum residue oil, light gas oil, and FCC DCO to produce fuel oil having 0.979 specific gravity (15/15° C.), 3.10 wt % sulfur, 160.314 cSt viscosity at 50° C., 76° C. flash point, 18.1% micro carbon residue, and 22.9° C. pour point. The fuel oil contains 67.0 vol % vacuum residue oil, 24.5 vol % light gas oil, 6.0 vol % aromatic solvent, 2.5 vol % FCC DCO, and 0.0 vol % kerosene. Surprisingly and unexpectedly, kerosene is reduced by 10.5 vol % and vacuum residue is increased by 4.0 vol % in comparison with conventional fuel oil by the addition of just 6.0 vol % aromatic blending component.

We claim:

1. A method for making a fuel oil blend comprising the steps of:

supplying an aromatic bottoms;

supplying an aromatic blending component from the aromatic bottoms;

blending the aromatic blending component with bulk fuel oil components to produce a fuel oil blend; wherein the bulk fuel oil components comprise a hydrocarbon component selected from the group consisting of: vacuum residue oil, light gas oil, kerosene, fluid catalytic cracking decant oil (FCC DCO), visbroken residues, delayed coking liquids, and combinations of the same;

wherein the aromatic blending component comprises a hydrodearylated aromatic bottoms.

2. The method of claim 1, wherein the aromatic blending component further comprises straight-run aromatic bottoms.

3. The method of claim 1, wherein the step of supplying an aromatic blending component from the aromatic bottoms further comprises hydrodearylating the aromatic bottoms to produce hydrodearylated aromatic bottoms;

fractionating the hydrodearylated aromatic bottoms to obtain a heavy hydrodearylated aromatic bottoms;

wherein the aromatic blending component comprises heavy hydrodearylated aromatic bottoms.

4. The method of claim 3, wherein the heavy hydrodearylated aromatic bottoms has an initial boiling point above 180° C.

5. The method of claim 3, wherein the heavy hydrodearylated aromatic bottoms comprises aromatic compounds having at least eleven carbon atoms.

6. The method of claim 1, wherein the step of supplying an aromatic blending component from the aromatic bottoms further comprises fractionating the aromatic bottoms to obtain a heavy aromatic bottoms, and wherein the aromatic blending component comprises the heavy aromatic bottoms.

7. The method of claim 6, wherein the heavy aromatic bottoms has an initial boiling point above 180° C.

8. The method of claim 6, wherein the heavy aromatic bottoms comprises aromatic compounds having at least eleven carbon atoms.

9. The method of claim 6, wherein the step of supplying an aromatic blending component from the aromatic bottoms further comprises:

hydrodearylating the heavy aromatic bottoms to produce hydrodearylated aromatic bottoms;

fractionating the hydrodearylated aromatic bottoms to obtain light alkyl monoaromatics and heavy hydrodearylated aromatic bottoms; and wherein the aromatic blending component comprises heavy hydrodearylated aromatic bottoms.

10. The method of claim 9, wherein the heavy hydrodearylated aromatic bottoms has an initial boiling point above 180° C.

11. The method of claim 9, wherein the heavy hydrodearylated aromatic bottoms comprises aromatic compounds having at least eleven carbon atoms.

12. The method of claim 1, further wherein the fuel oil blend comprises the aromatic blending component in a range of 2 vol % to 6 vol %.

* * * * *